US007121054B2

(12) United States Patent
Shock

(10) Patent No.: US 7,121,054 B2
(45) Date of Patent: Oct. 17, 2006

(54) METHOD AND/OR APPARATUS FOR DRYWALL REPAIR

(76) Inventor: Thomas P. Shock, 15732 Marcie, Fraser, MI (US) 48026

( * ) Notice: Subject to any disclaimer, the term of this patent is extended or adjusted under 35 U.S.C. 154(b) by 408 days.

(21) Appl. No.: 10/695,333

(22) Filed: Oct. 28, 2003

(65) Prior Publication Data

US 2005/0086889 A1 Apr. 28, 2005

(51) Int. Cl.
*E02D 37/00* (2006.01)

(52) U.S. Cl. ..... 52/514.5; 52/742.1

(58) Field of Classification Search ..... 52/514, 52/514.5, 742.1

See application file for complete search history.

(56) References Cited

U.S. PATENT DOCUMENTS 2,598,197 A * 5/1952 Shippey ..... 52/514
3,205,904 A * 9/1965 Kreachbaum ..... 135/19.5
3,325,955 A * 6/1967 Haut ..... 52/514
4,075,809 A * 2/1978 Sirkin ..... 52/514
4,285,183 A * 8/1981 Condit ..... 52/514
4,406,107 A * 9/1983 Schoonbeck ..... 52/514
4,471,594 A * 9/1984 Doyle ..... 52/514
5,058,519 A * 10/1991 Collins ..... 114/227
5,983,587 A * 11/1999 Limonad ..... 52/514
6,508,040 B1 * 1/2003 Nelson ..... 52/514
6,607,621 B1 * 8/2003 Swanson ..... 156/94

OTHER PUBLICATIONS

"Hole-In-One Drywall Repair", *Workbench*. Oct. 2003, 1 page.

* cited by examiner

*Primary Examiner*—Naoko Slack
*Assistant Examiner*—Jessica Laux

(57) ABSTRACT

An apparatus for repairing a hole in a wall. The apparatus comprises an end section, a connection section and a fastener section. The end section may have an area larger than the hole and a cross-section smaller than the hole. The end section may be a continuous piece. The connection section generally has a first end connected to the end section. The fastener section is generally connected to a second end of the connection section.

8 Claims, 8 Drawing Sheets

METHOD AND/OR APPARATUS FOR DRYWALL REPAIR

FIELD OF THE INVENTION

The present invention relates to drywall generally, and, more particularly, to a method and/or apparatus for drywall repair.

BACKGROUND OF THE INVENTION

Drywall is a common construction material used in both new and used residential and business applications. After drywall is installed, damage can occur from a number of sources. For example, a door handle may poke a hole into an existing drywall installation. Conventional systems for patching such holes involve placing some sort of backing material inside the hole. The backing material needs to be glued or otherwise secured to the inside of the damaged drywall area. Since the inside of a wall is often also enclosed by another sheet of drywall on the opposite side of the wall, access to the interior portion of the wall is not easily obtained. Conventional drywall repair approaches often involve increasing the size of the hole to a sufficiently large size to wedge a backing material into the hole with a pair of pliers or other similar tool. After the backing material drys, a drywall patching material (often in a paste form) is applied, sanded, finished, etc. However, since the backing material is glued in place from the outside, if the glue does not hold until the patch is dry, the drywall patch can fall into the inside of the wall, either during the patching processing or after the patching process, making the patch unacceptable and/or unuseable.

It would be desirable to implement a drywall patch that provides a secure backing without the need to enlarge the damaged area.

SUMMARY OF THE INVENTION

One aspect of the present invention concerns an apparatus for repairing a hole in a wall. The apparatus comprises an end section, a connection section and a fastener section. The end section may have an area larger than the hole and a cross-section smaller than the hole. The area may be a continuous piece. The connection section generally has a first end connected to the end section. The fastener section is generally connected to a second end of the connection section.

Another aspect of the present invention concerns a method for repairing a hole in a wall, comprising the steps of (A) cutting a groove across the hole, where the groove has a width narrower than a width of said hole, (B) inserting an end piece through the groove into an area behind the wall, (C) pulling the end piece up to an inside portion of the wall using a connection section, and (D) securing the end piece to the wall. The end piece is generally secured against the wall.

The objects, features and advantages of the present invention include providing a method and/or apparatus for drywall repair that may (i) be implemented from the outside of a wall, (ii) be cost effective, and/or (iii) be easy to use.

BRIEF DESCRIPTION OF THE DRAWINGS

These and other objects, features and advantages of the present invention will be apparent from the following detailed description and the appended claims and drawings in which:

DETAILED DESCRIPTION OF THE PREFERRED EMBODIMENTS

Figure 1:
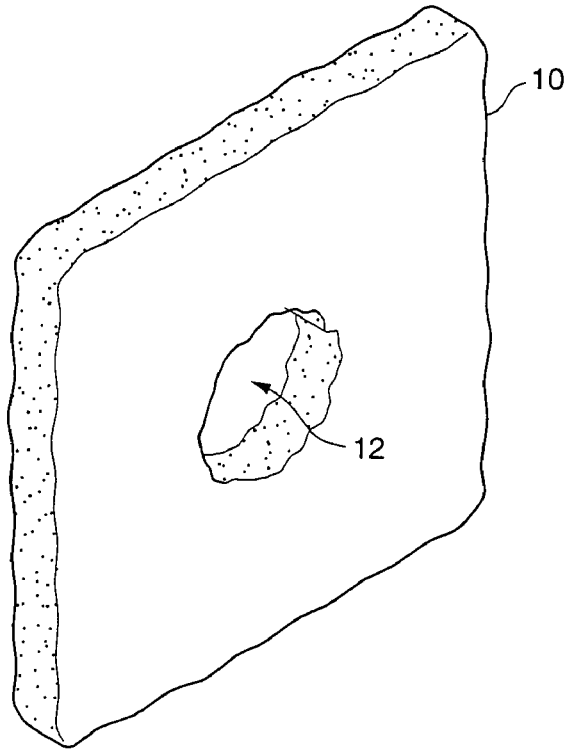
FIG. 1 is a diagram illustrating perspective view of a piece of drywall with a hole.

Referring to FIG. 1, a diagram illustrating a cutout of a piece of drywall 10 with a hole 12 is shown. The hole 12 may arise from an external impact (or other undesirable force) to the drywall 12. The hole 12 may be completely through the drywall 10, or merely an indentation into the wall 10. In the case where the hole 12 is an indentation, the hole 12 may need to be extended through the drywall 10 prior to implementing the method and/or apparatus of the present invention.

Figure 2:
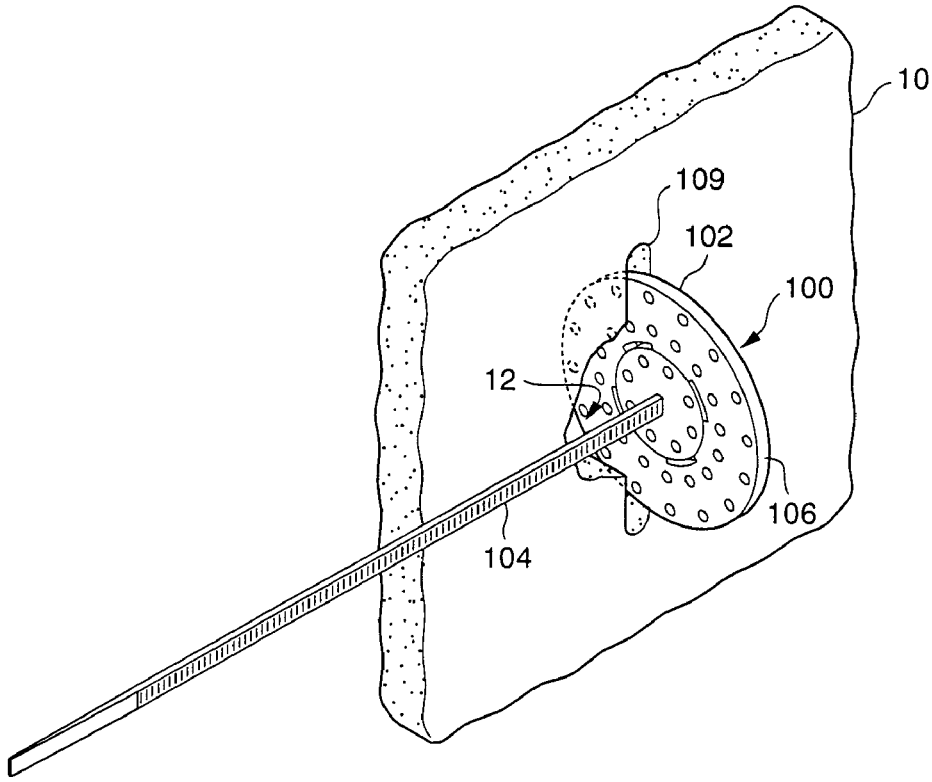
FIG. 2 is a diagram of the present invention being inserted into the hole.

Referring to FIG. 2, a diagram of an insert 100 of the present invention in shown. The insert 100 is shown being inserted into the hole 12. The insert 100 generally comprises an end piece 102 and a connection piece 104. The end piece 102 is shown as a generally disk shaped piece. However, other shapes, such as a square, a hexagon, octagon, etc. may be used to implement the end piece 102 to meet the design criteria of a particular implementation. A flat portion of the end piece 102 is normally larger than a diameter of the hole 12. A side portion 106 is generally implemented having a cross section narrower than the width of the hole 12. A slot 109 is normally cut into the hole 109 to allow the insert 100 to slide into the backside of the wall 100. The cross section should be sufficiently thick to provide a ridged end piece 102. For example, if the end piece 102 is made from metal, the cross section may be 1/16 of an inch to 1/8 of an inch may be used. If the end piece 102 is made from plastic, the cross section may be from 1/32 of an inch to 1/8 of an inch. However, other thicknesses may be implemented to meet the design criteria of a particular implementation. The end piece 102 may be implemented as a continuous piece (e.g., without slots through the side portion 106).

The connection piece 104 may be implemented as a piece sufficient to hold the end piece 102 on the back of the drywall 10. The connection piece 104 generally provides enough room to be held on the front of the drywall while an adhesive, used to secure the insert 100 to the drywall 10, is allowed to dry. Once the adhesive does dry, most of the connection piece 104 is normally cut away and removed. A portion of the connection piece 104 may be left in the hole 12 and covered with drywall mud (to be described in more detail in connection with FIG. 3). Drywall mud is a term used to describe the paste-like material used to fill holes in drywall. In general, any type of mud may be used with the present invention.

Figure 3:
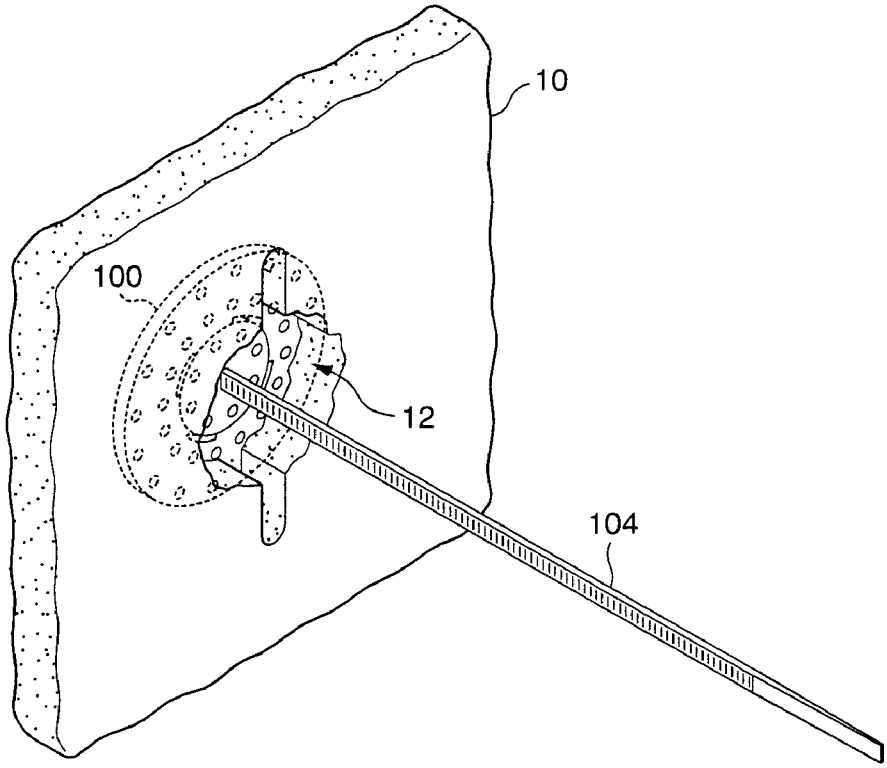
FIG. 3 is a diagram illustrating the present invention being tensioned within the hole.

Referring to FIG. 3, a diagram illustrating the insert 100 being tensioned within the hole 12 is shown. The insert is normally pulled into the backside of the wall 10 by the connection piece 104. The insert 100 is normally glued in place with an adhesive such as epoxy, general purpose glue, etc.

Figure 4:
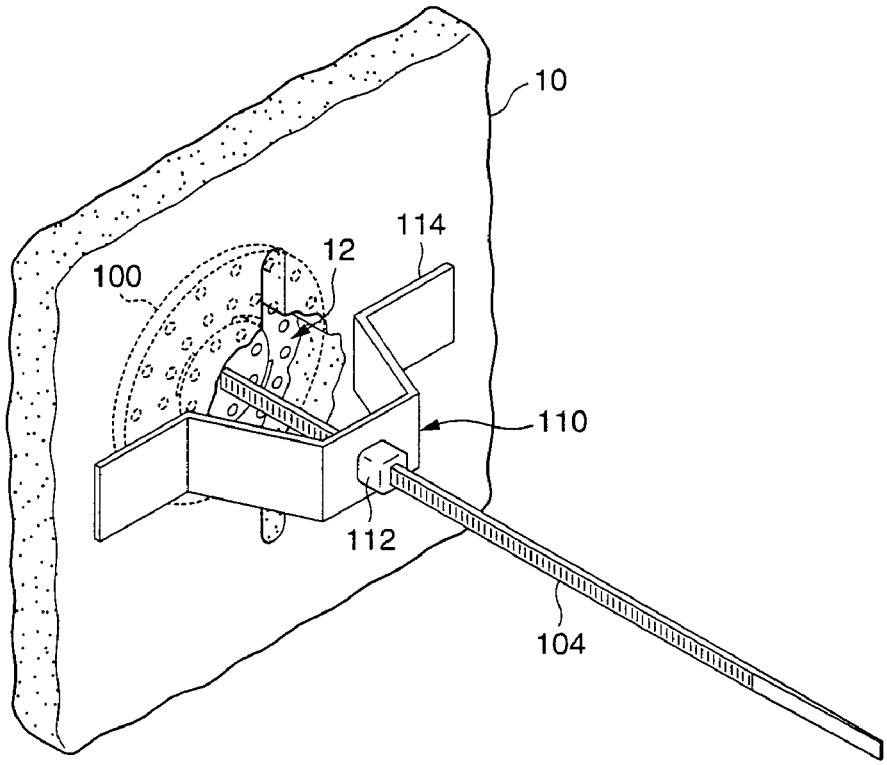
FIG. 4 is a diagram illustrating a clamp holding the present invention in place.

Referring to FIG. 4, a diagram illustrating a clamp holding the insert 100 in place is shown in accordance with a preferred embodiment of the present invention. An end of the connection piece 104 is shown being secured by a tensioner 110. In one example, the connection piece 104 may be implemented as a first portion of a tie-wrap. In another example, the connection piece may be implemented as a string. The tensioner 110 may be implemented as a second portion of a tie wrap 112 connected to a clip 114. However, other connection pieces 104 may be implemented to meet the design criteria of a particular implementation. For example, the connection piece 104 may be implemented as a rubber band. Such a rubber band implementation may be stretched around the tensioner 110 without the need for a tie wrap assembly. Once the adhesive has dried, the rubber band, tie wrap, string, etc. may be cut away from the tensioner 110. In the example of a rubber band, the rubber band may simply be tucked into the hole 12 prior to completing the repair.

While the insert 100 is shown as a disked shaped object, other shapes and/or materials may be implemented to meet the design criteria of a particular implementation. For example, the connection piece 104 may be secured to a plastic sheet. The plastic sheet may be cut to a size larger than the size of the hole 12. The plastic piece may be sufficiently flexible to be rolled and inserted through the hole 12, but sufficiently rigid to hold drywall mud. Furthermore, the plastic sheet may be made of cardboard or other type of appropriate material (e.g., semi-rigid). Furthermore, the insert 100 may be made of an expandable umbrella shaped configuration having a connection piece 104 implemented using any of the described alternates. Furthermore, more than one insert 100 may be used to repair a gash or elongated type of hole 12. In any of the examples, a finishing step of applying a mesh or thin paper coating may be used to provide a long-lasting repair.

Figure 5:
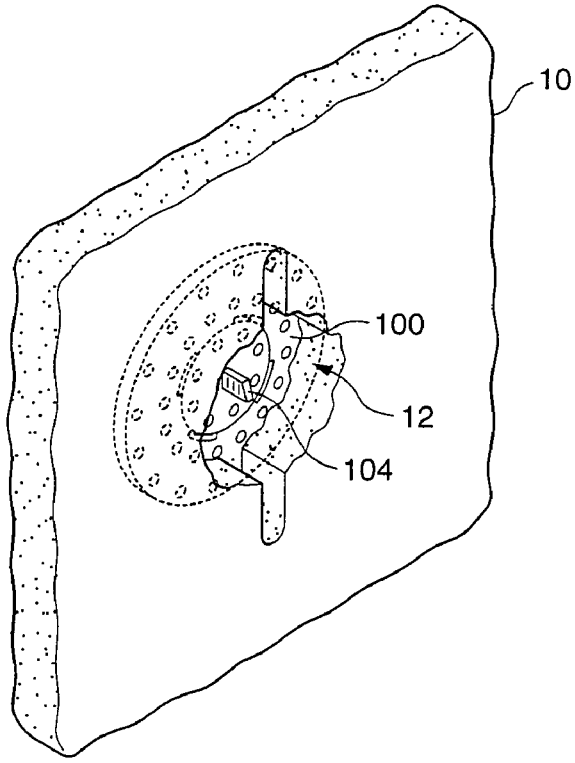
FIG. 5 is a diagram illustrating the present invention after the clamp and tensioning device are removed.
Figure 6:
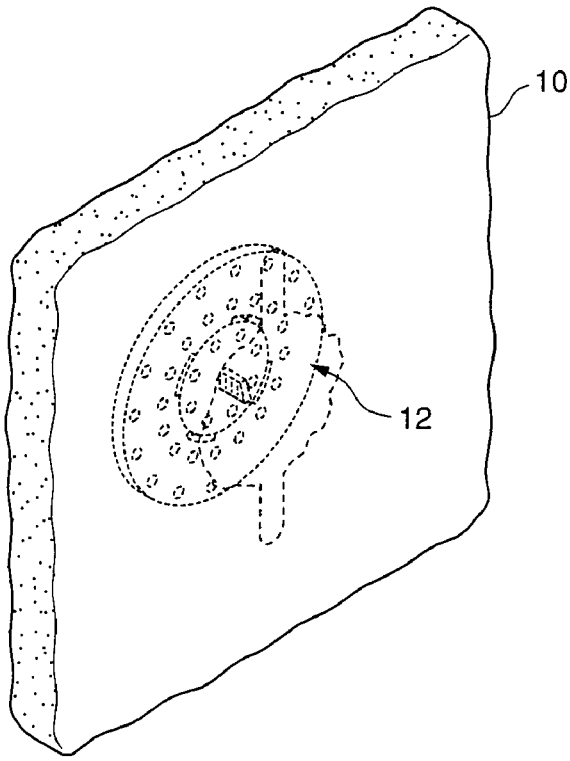
FIG. 6 is a diagram illustrating patching material being placed in the recess left in hole.

Referring to FIG. 5, a diagram illustrating the present invention with the tensioning device 110 removed is shown. Referring to FIG. 6, a diagram illustrating patching material being placed in the recess left by the hole is shown.

Figure 7C:
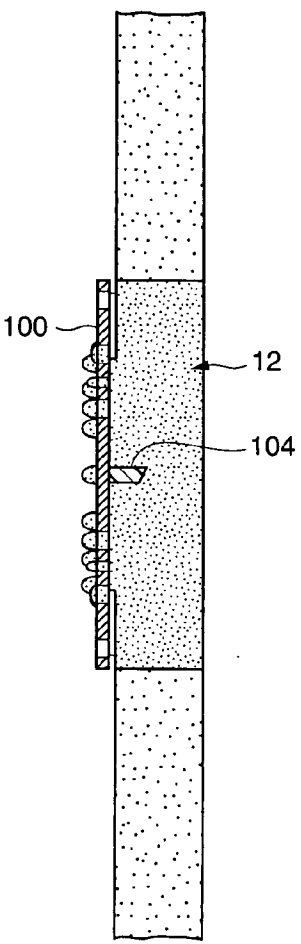
FIGS. 7*a*–7*c* illustrate cross sections of the present invention at various stages.
Figure 7B:
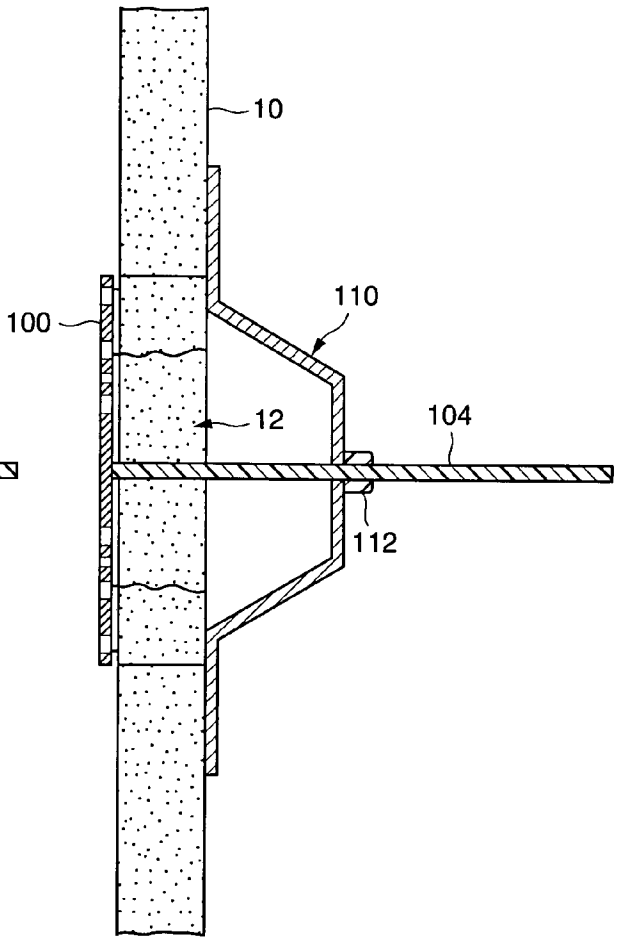
Figure 7A:
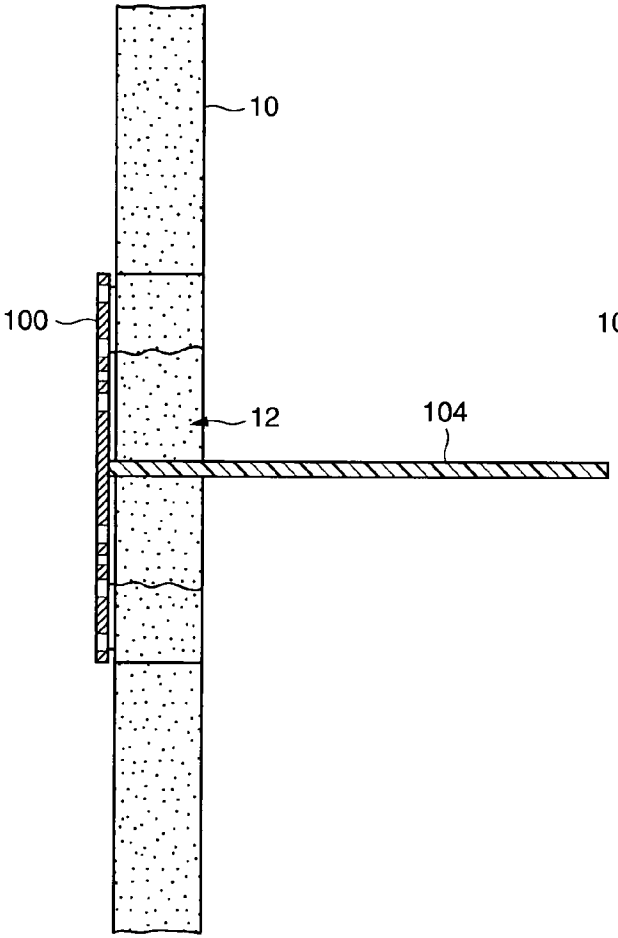

Referring to FIGS. 7*a*–7*c*, illustrations of cross sections of the present invention are shown. In FIG. 7*a*, the insert 100 is shown held in place by the connection piece 104. In FIG. 7*b*, the tensioner 110 is shown holding the connection piece 104 and the insert 100 in place. A piece 112 may be implemented on the tensioner 110. The piece 112 may be implemented as a second portion of a tie wrap (in the case where the connection piece 104 is implemented as a first portion of a tie wrap). In FIG. 7*c*, the connection piece 104 is shown cut off. The hole 12 is shown filled with drywall mud.

Figure 8:
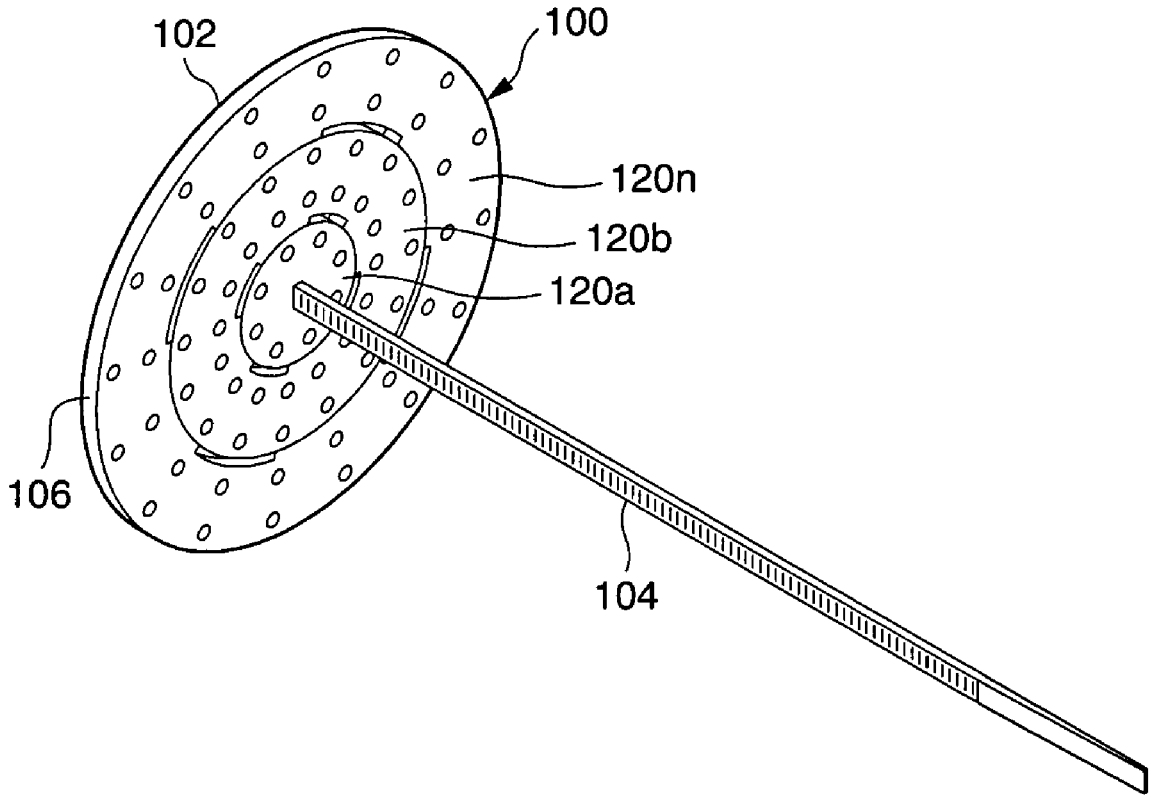
FIG. 8 is a diagram of an alternate embodiment of the present invention.

Referring to FIG. 8, a diagram of an alternate implementation of the present invention is shown. The insert 100 is shown formed with a number of concentric rings 120*a*–120*n*. Each of the concentric rings may be used to a large diameter of the insert 100. While concentric rings 120*a*–120*n* are shown, more than three rings may be implemented to meet the design criteria of a particular implementation. Once a particular hole has been selected to repair, one or more of the insert portions 120*a*–120*n* may be removed from the insert 100 to provide a proper diameter of the insert 100. In particular, the diameter of the insert 100 should be larger than the hole 12 to be repaired, but not so large as to need an excessively large slot 109.

Figure 9:
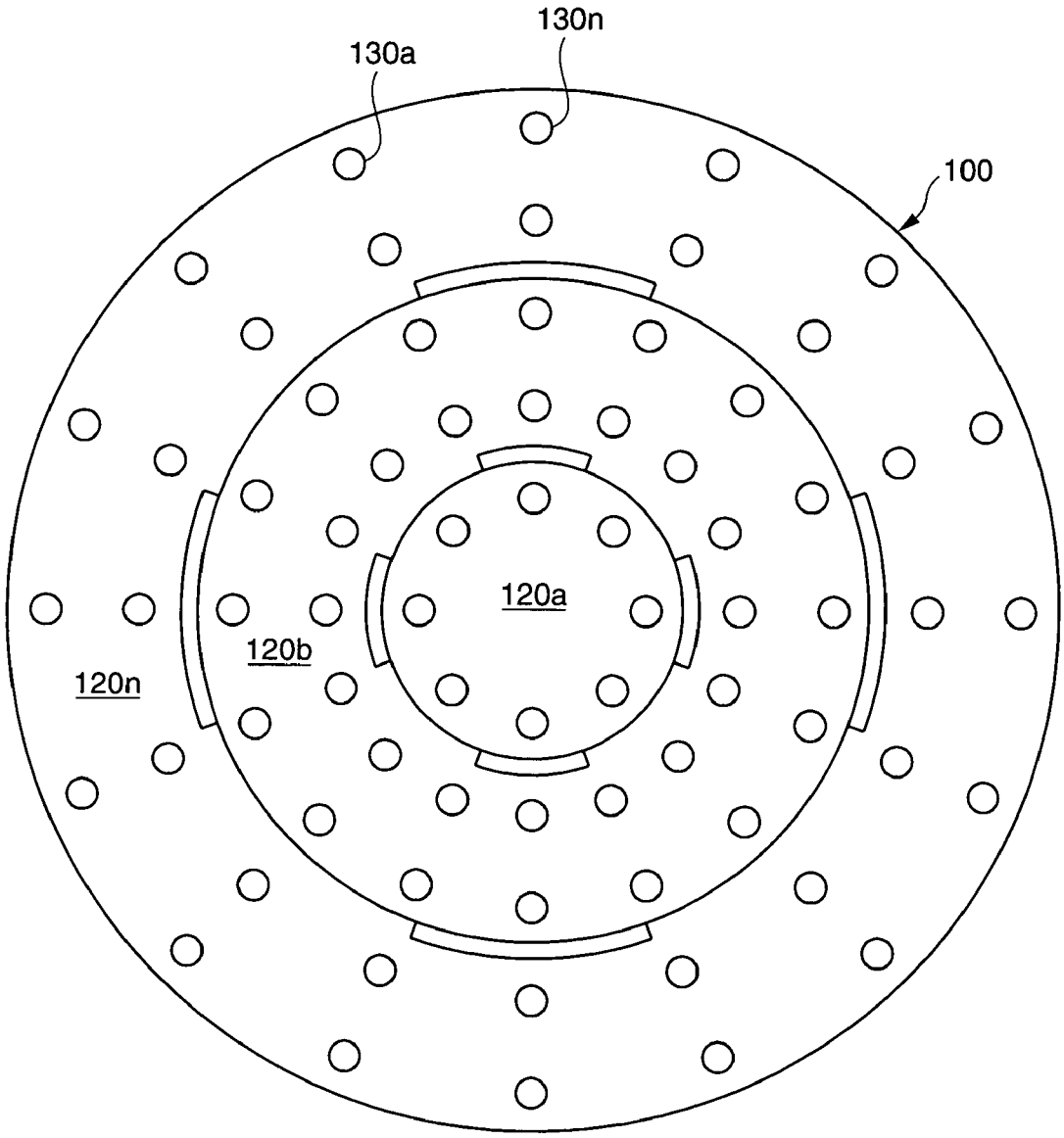
FIG. 9 is a diagram illustrating a cross section of the alternate embodiment.

Referring to FIG. 9, a cross section of the alternate implementation of the insert is shown. Additionally, a number of holes 130*a*–130*n* are shown in each of the rings 120*a*–120*n*. The holes 130*a*–130*n* may be used to allow the drywall material to flow through the insert 100 to further aid in the patching of the hole.

Figure 10:
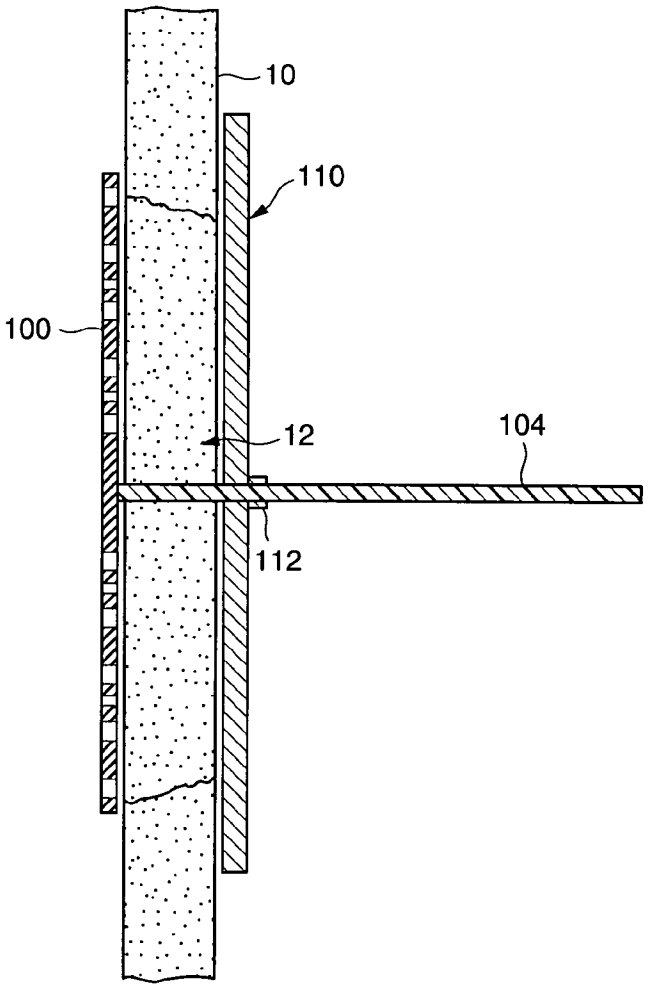
FIG. 10 is a diagram illustrating an alternate tensioner.

Referring to FIG. 10, a cross section illustrating the alternate embodiment of the present invention is shown. The insert 100 is shown large enough to fill a larger hole than shown in FIG. 2. Since the hole 12 is larger, the tensioner 110 as shown in FIG. 4, would need to be fairly large to extend past the hole in the drywall. Furthermore, FIG. 10 illustrates a tensioner 110 implemented as a stick type member. The piece 112 may still be used to connect to the connection piece 104.

Figure 11:
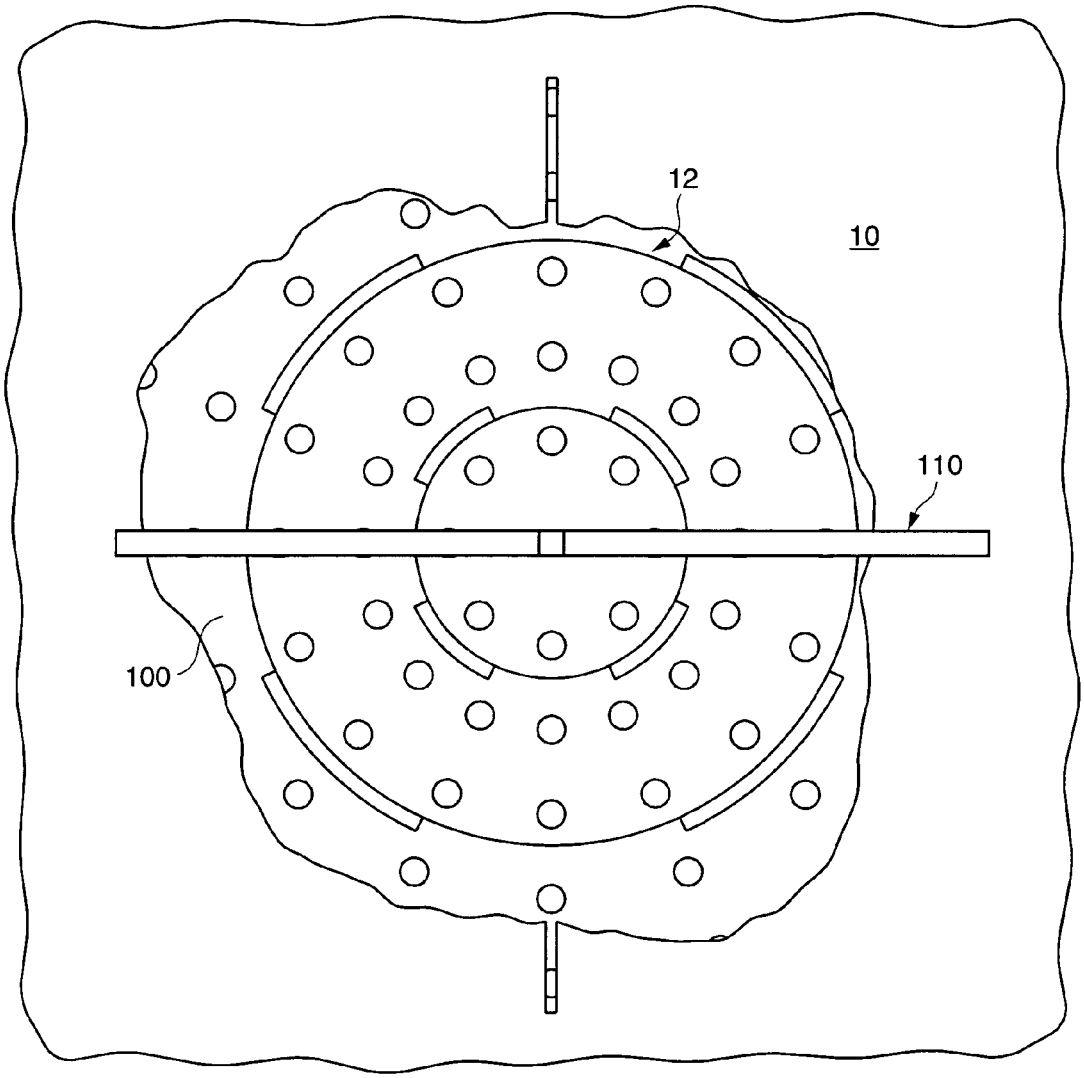
FIG. 11 is a diagram illustrating a cross section view of the alternate embodiment.

Referring to FIG. 11, a cross section of the drywall 10 is shown with an alternate implementation of the invention. FIG. 11 illustrates the alternate implementation of the insert 100 being held in place with the hole 12.

While the invention has been particularly shown and described with reference to the preferred embodiments thereof, it will be understood by those skilled in the art that various changes in form and details may be made without departing from the spirit and scope of the invention.

The invention claimed is:

1. An apparatus for repairing a hole in a wall comprising:

a end section having an area larger than said hole and a cross-section smaller than said hole, wherein said area comprises a continuous piece;

a connection section having a first end connected to said end section; and a fastener section connected to a second end of said connection section, wherein (i) said end section comprises a plurality of concentric sections and (ii) one or more of said concentric sections is removable to adjust the area of said end section.

2. The apparatus according to claim 1, wherein said apparatus is inserted into a slot cut across said hole, wherein said apparatus is inserted without increasing the size of said hole.

3. The apparatus according to claim 1, wherein said end section has a disk shape.

4. The apparatus according to claim 1, wherein:

said connection section comprises a first portion of a tie-wrap and said fastener section includes a second portion of a tie-wrap, wherein said first and second portions of said tie-wrap form a secure connection.

5. The apparatus according to claim 1, wherein said connection section comprises an elastic material stretchable over said fastener section.

6. The apparatus according to claim 1, wherein said wall comprises drywall.

7. The apparatus according to claim 1, wherein said end section comprises a semi-rigid piece of plastic.

8. The apparatus according to claim 1, wherein said end section comprises a semi-rigid piece of cardboard.

* * * * *